United States Patent [19]

Bennett

[11] 4,147,306

[45] Apr. 3, 1979

[54] FOAM PRODUCING APPARATUS

[76] Inventor: Robert S. Bennett, 170 Sturbridge Rd., Easton, Conn. 06425

[21] Appl. No.: 837,557

[22] Filed: Sep. 28, 1977

[51] Int. Cl.[2] ..... B67D 5/58

[52] U.S. Cl. ..... 239/327; 239/343; 239/372; 222/212

[58] Field of Search ..... 239/327, 328, 343, 372; 222/189, 190, 211, 212

[56] References Cited

U.S. PATENT DOCUMENTS

| | | | |
|---|---|---|---|
| 3,176,883 | 4/1965 | Davis, Jr. | 222/212 X |
| 3,622,049 | 11/1971 | Thompson | 239/327 X |
| 3,963,150 | 6/1976 | Steiman et al. | 222/211 |
| 3,973,701 | 10/1976 | Gardner | 222/190 |
| 3,985,271 | 10/1976 | Gardner | 239/343 X |

*Primary Examiner*—Robert W. Saifer

[57] ABSTRACT

Foam is produced when a reservoir is deformed by squeezing. When pressure is applied to the reservoir, a flexible washer seals a vent passage while liquid is forced up through a tube, a ball valve and outwardly through a radially slotted member, while air passes through orifices in the washer and along the outside of the slotted member to mix with the liquid. The mixture is then discharged when pressure is released, the valve is sealed and suction pulls the washer away from the vent to allow air back into the reservoir.

6 Claims, 4 Drawing Figures

FIG. 1
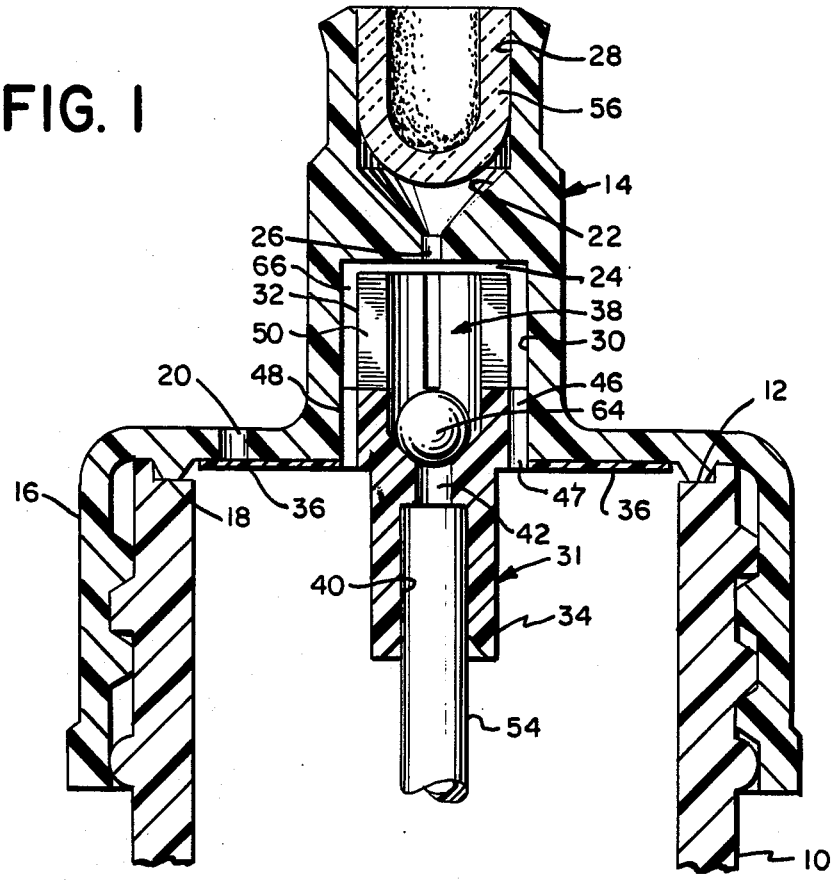
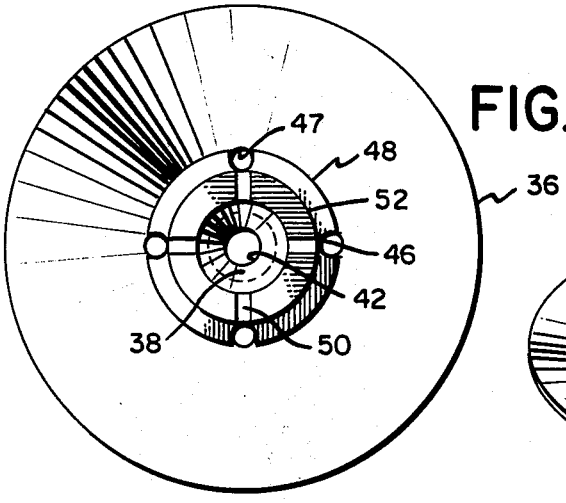
FIG. 3
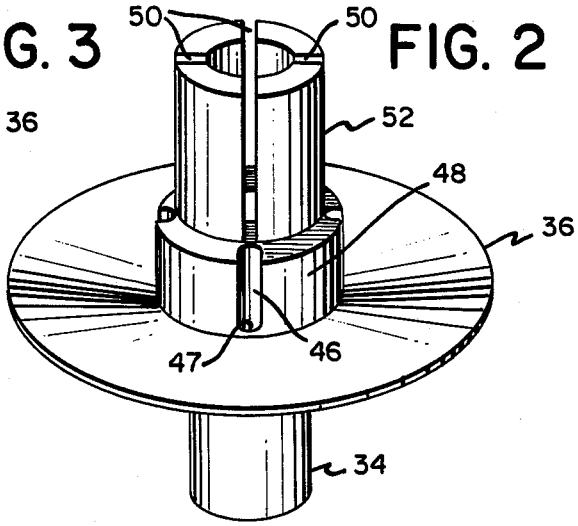
FIG. 2
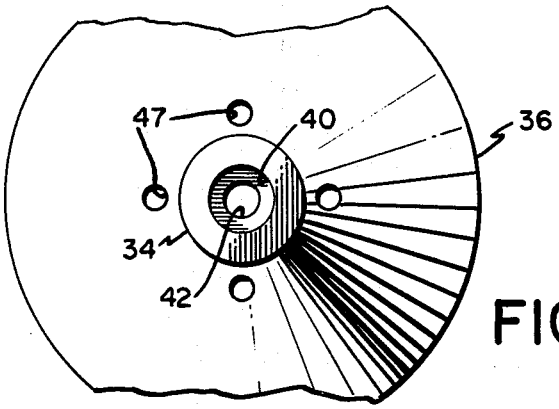
FIG. 4

FOAM PRODUCING APPARATUS

PRIOR ART STATEMENT

Known foam producing devices of the same general type as disclosed herein are shown in the following U.S. Pat. Nos.

2,223,256
2,281,447
2,715,981
3,176,883
3,422,993
3,709,437
3,874,562
3,937,364
3,973,701
4,022,351

The invention differs both in structure and in function from the devices shown in the above identified patents.

BACKGROUND OF THE INVENTION

Known foam producing devices as for example in U.S. Pat. No. 3,709,437 employ a deformable reservoir containing foamable liquid and air, a discharge orifice, foam producing means including a foam homogenizing overlay or filter, and a ball check valve disposed in the foam producing means. The means also has air passages in a well portion which defines a mixing chamber. When the reservoir is compressed, the liquid and air are mixed in the chamber. The mixture is passed through the overlay to produce foam which is then discharged through the orifice. The check valve prevents downward flow of the liquid after the compression force in the reservoir is released, thus reducing the time to produce foaming upon subsequent compression. While the reservoir is returning to its uncompressed state after the compression force is released, air flows from outside the device in reversed direction through the same air passages into the reservoir for use in subsequent foam producing operations. These known devices provide separate passages for air and liquid to flow upward to the chamber when the reservoir is compressed.

Normally these devices are held in vertical position. However, if such a device is tilted appreciably from the vertical in use, as for example at an angle of 45°, depending upon the relative levels of air and liquid in the reservoir, the air may flow upward through the passage used to conduct liquid while the liquid may flow upward through the passage used to conduct fluid. The passages used for air differ in length and cross sectional area differ from those used for liquid whereby this interchange of passages creates blockages and other malfunctions.

Sometimes the device will not function at all thereafter. At the very least, the device must be returned to vertical position and the reservoir squeezed and released repeatedly until normal functions is restored.

This invention overcomes these disadvantages by preventing such interchange of passages for air flow and liquid flow.

SUMMARY OF THE INVENTION

In accordance with the principles of this invention, a device for producing foam from a foamable liquid and air comprises a vertical reservoir with an open neck adapted to contain a quantity of foamable liquid and air. The reservoir is deformed when squeezed and automatically returns to undeformed state when squeezing pressure thereon is released.

A first vertically elongated member is provided with an enlarged lower end engaging the neck. The lower end has a flat horizontal bottom surface covering the neck. A first vertical channel extends through the lower end to communicate with the bottom surface. The first member has a first upper section and a second lower section having a bottom circular opening flush with the bottom surface. The first and second sections are interconnected by a second vertical channel, both sections having vertical cylindrically shaped inner walls. The inner wall of the first section tapers inwardly in the vicinity of the second channel.

A second vertically elongated member has upper and lower extensions disposed respectively within and spaced from the second section and the reservoir respectively, said second member having a flat circular flexible horizontal washer disposed between said extensions and extending radially outward along the bottom surface past the first channel. The second member has a second chamber with a third upper section disposed in the upper extension and communicating with a top opening in the upper extension, said second chamber having a fourth lower section disposed in the lower extension and communicating with a bottom opening in the lower extension. The third and fourth sections are interconnected by a third vertical channel.

The washer has spaced openings communicating with a region in the second section intermediate the inner wall of the second section and the upper extension of the second member. The upper extension has spaced vertical slots communicating between the region and the third section. A ball vertically movable in the third section has a diameter larger than that of the third channel.

When the reservoir is squeezed, liquid passes upwardly from the reservoir, through the fourth section and third channel, forcing the ball upward and then flowing first into the third section and out of the slots into the region intermediate the inner wall of the second section and the upper extension of the second member. At the same time air flows upward from the reservoir through the holes in the washer into this region. The direction of air and liquid flow are essentially at right angles whereby mixing occurs in the region. The mixture forces its way upward through the second channel into the first section. A foam filter is disposed in the top open end of the first section and as the mixture flows through the filter, the desired foam is produced. The air pressure thus developed in the reservoir forces the washer flush against the bottom opening in the first channel, preventing air entry therethrough.

When the squeezing force on the reservoir is released, the inwardly directed suction moves the washer out of sealing engagement with the first channel whereby air can flow from the outside into the reservoir.

The air flow passages employed in this invention are so disposed that the device can be inclined almost to the horizontal without permitting foamable liquid to flow through these passages. Similarly, the liquid flow passage is so disposed that unless the reservoir has been emptied of liquid, air will not flow in the liquid flow passage. Consequently, the device can be used at discharge angles substantially inclined from the vertical in normal operation and blockages and other malfunctions will not occur.

BRIEF DESCRIPTION OF THE DRAWINGS

FIG. 1 shows the invention in vertical cross section.

FIG. 2 is a perspective view of certain parts employed in the invention.

FIG. 3 is a top view of the structure shown in FIG. 2.

FIG. 4 is a bottom view of the structure shown in FIG. 4.

Referring now to FIGS. 1–3, a deformable vertical plastic reservoir 10 has an open neck 12 and contains a quantity of defoamable liquid and air.

A first vertically elongated plastic member 14 has an enlarged open lower end 16 which threadedly engages the neck and has a flat horizontal bottom surface 18 covering the neck. A first vertical channel 20 in the form of a cylindrical bore extends from the outside and communicates with the bottom surface. Member 14 has a first chamber with a first upper section 22 and a second lower section 24. These sections are interconnected by a second vertical channel 26 or cylindrical bore having a diameter smaller than that of channel 20. Both sections 22 and 24 have vertical cylindrically shaped inner walls. The inner wall of the first section 22 tapers inwardly in the vicinity of the second channel. Section 22 has a top circular opening 28 flush with the top of member 14 and much larger in diameter than any of the channels (including the third channel described below). Section 24 has a bottom circular opening 30 flush with the bottom of member 14 and having a diameter somewhat larger than that of opening 28.

A second vertically elongated plastic member 31 has upper and lower extensions 32 and 34 disposed respectively within and spaced from the second section and the reservoir respectively and also has a flat circular thin flexible horizontal washer 36 disposed between the extensions and extending radially outward along surface 18 past channel 20. Member 30 has a second chamber with a third upper section 38 disposed in the upper extension and communicating with a top opening therein as well as a fourth lower section 40 disposed in the lower extension and communicating with a bottom opening in the lower half. A third channel 42 or vertical cylindrical bore having a diameter somewhat larger than that of channel 26 interconnects the third and fourth sections.

Washer 36 has four equidistantly spaced openings 47 which are connected by corresponding outer vertical grooves 46 in a vertical hollow outer cylinder 48 forming a lower part of the upper extension to the bottom of corresponding vertical slots 50 in a smaller diameter vertical hollow cylinder 52 forming an upper part of the upper extension.

A dip tube 54 secured at its upper end in section 40 extends downwardly to a point just above the bottom of the reservoir. The second and third channels and tube 54 have a common vertical axis which is also the vertical axis of the reservoir. A foam filter 56 is disposed in the top opening of the first member and extends downwardly therein whereby in vertical cross section the filter has the shape of a U. A cap with discharge channel and discharge orifice can be secured to the top of member 30.

A plastic ball 64 vertically movable in the section 38 has a diameter larger than that of channel 42 and smaller than that of the third section 38.

When the reservoir is deformed by squeezing, the pressure forces washer 36 to seal channel 20 while the liquid is forced up through the tube, channel 42, the third section 38 and outwardly through the slots 50 at approximately right angles into a region 66 between the inner wall of section 24 and the first half of the second member. Air is forced upward through openings 47 and grooves 46 vertically upward into region 66 to mix with the liquid. (The pressure has caused ball 67 to be raised and open channel 42). The mixture then forms a fine mist spray and flows upwardly through channel 26, the first chamber and then through the filter whereby the foam is produced and discharged thereafter.

When the squeezing pressure is released and the reservoir returns to normal shape the ball falls to seal the channel 42 and the suction momentarily pulls the washer downward away from the opening of channel 20 whereby air is supplied from the outside to the reservoir.

The position of openings 47 is such that the reservoir can be tilted substantially more than 45° with respect to the vertical without allowing any liquid to pass through these openings. Similarly, as long as there is enough liquid in the reservoir to permit further use, such tilting will not permit air to pass upward through the tube.

What is claimed is:

1. A device for producing foam from a foamable liquid and air, said device comprising:

a deformable vertical reservoir having an open neck and adapted to contain a quantity of foamable liquid and air;

a first vertically elongated member provided with an enlarged lower end engaging the neck and having a flat horizontal bottom surface covering the neck, said lower end having a first vertical channel extending from the outside of the member therethrough to communicate with the bottom surface, said first member having a first chamber with a first upper section having a circular top opening flush with the top of the first member and a second lower section having a bottom circular opening flush with the bottom surface, said first and second sections being interconnected by a second vertical channel, both sections having vertical cylindrically shaped inner walls, the inner wall of the first section tapering inwardly in the vicinity of the second channel;

a second vertically elongated member having upper and lower extensions disposed respectively within and spaced from the second section and the reservoir respectively, said second member having a flat circular flexible horizontal washer disposed between said extensions and extending radially outward along the bottom surface past the first channel, said second member having a second chamber with a third upper section disposed in the upper extension and communicating with a top opening in the upper extension, said second chamber having a fourth lower section disposed in the lower half and communicating with a bottom opening in the lower extension, the third and fourth sections being interconnected by a third vertical channel, said washer having spaced openings communicating with a region intermediate the inner wall of the second section and the upper extension of the second member, said upper extension having spaced vertical slots communicating between said region and said third section; and a ball vertically movable in the third section and having a diameter larger than that of the third channel.

2. The device of claim 1 wherein a vertical hollow dip tube is disposed in the reservoir and is connected at its top end to the fourth section.

3. The device of claim 2 wherein the number of openings in the washer is equal to the number of slots in the upper half of the second member.

4. The device of claim 3 wherein the second and third channels are vertical cylindrical bores which have a common vertical axis.

5. The device of claim 4 wherein the diameter of the second channel is smaller than that of the third channel.

6. The device of claim 5 wherein the slots extend downward from the top end of the upper extension to a position adjacent but above the top of the second channel, the portion of the upper extension disposed between the bottom of the slots and the washer being a hollow vertical cylinder having a plurality of vertical grooves equal in number to the number of slots, each groove being connected to the corresponding washer opening and aligned with the corresponding slot.

* * * * *